US005255576A

United States Patent [19]

Keith

[11] Patent Number: 5,255,576

[45] Date of Patent: Oct. 26, 1993

[54] ADJUSTABLE UNIVERSAL RATCHETING FIRE HYDRANT WRENCH

[76] Inventor: John R. Keith, 1845 Fay Dr., Parma, Ohio 44134

[21] Appl. No.: 861,925

[22] Filed: Apr. 1, 1992

[51] Int. Cl.[5] ..... B25B 13/00

[52] U.S. Cl. ..... 81/63; 81/63.2; 81/125

[58] Field of Search ..... 81/63, 63.2, 125, 185

[56] References Cited

U.S. PATENT DOCUMENTS

| | | | |
|---|---|---|---|
| 951,056 | 3/1910 | Clark | 81/63 |
| 2,004,639 | 6/1935 | Thewes | 81/63.2 X |
| 3,318,176 | 5/1967 | Geier | 81/185 X |
| 4,328,720 | 5/1982 | Shiel | 81/63 |

*Primary Examiner*—James G. Smith

[57] ABSTRACT

An adjustable universal ratchet wrench consisting of a forged handle, ratcheting mechanism and a multi-configurated socket with adjustment bolt for opening and closing fire hydrant valves and removal and replacement of hydrant caps of various shapes and sizes.

4 Claims, 3 Drawing Sheets

ADJUSTABLE UNIVERSAL RATCHETING FIRE HYDRANT WRENCH

BACKGROUND

1. Field of the Invention

This invention relates to ratcheting wrenches, specifically to wrenches used to open and close fire hydrant actuating valves and to remove and replace hose connection caps on fire hydrants.

2. Description of Prior Art

The primary function of fire hydrants is to provide fire fighters with a fast and reliable method of connection to water mains. A major problem often experienced by firefighters is caused by the location of fire hydrants with regard to other structures. When they are located near a building or fence it is not possible to swing or rotate the wrench 360 degrees. Despite local and state laws and regulations, firefighters may also be confronted with fire hydrants that are in close proximity to walls, parked vehicles, phone booths, telephone and sign posts, etc. My invention permits standing in one position and utilizes the ratcheting mechanism to eliminate walking around the hydrant. This ratcheting feature has proven to be desirable even for hydrants that are fully accessible. Many injuries have been caused by slipping on wet grass, by slipping off the road curbing concealed by snow and ice, and while perhaps humorous to some who have not experienced the situation, firefighters have been seriously injured by slipping on dog excretement commonly found around fire hydrants.

Unfortunately, vandalism and other unauthorized misuse of fire hydrants, particularly in large cities, has made it necessary to equip fire hydrants with tamper resistant fittings. These tamper proof fittings are often made by altering the shape of the stem end that activates the valve. Commonly, this results in different shapes and sizes for individual manufacturers hydrants.

Various methods of tamper proofing have been proposed. U.S. Pat. No. 4,936,336 by McCauley discloses recessed slots and requires a mating wrench. In addition to the much higher costs of manufacturing such proposed tamper proofing devices they often suffer failures due to their location. Many hydrants are in close proximity to roads and a great deal of road dust and dirt may accumulate in the internal slots or cavities. Also, weather conditions may result in ice or snow preventing the engagement of the operating wrench.

Another method of discouraging vandalism is to provide several different sizes of fittings on the same hydrant. Currently in the U.S. sizes vary from 15/16 inches to 1¾ inches and more. They are also square, pentagon and hexagon. Regrettably, with this simple tamper proofing method of varying the sizes and shapes of the actuating nuts and caps on the fire hydrants, the firefighter is faced with the necessity of transporting several different wrenches. There are approximately 50 to 100 different sizes and shapes of nuts and caps supplied over the long period of time of hydrant use. Obviously, this creates problems greater than the vandalism. My invention provides a wrench that is rapidly adjustable to fit virtually all or most fire hydrant nuts and caps.

My invention responds to the need for a wrench that is operable in all weather conditions and that resists jamming due to sand, grit and other contaminants. My invention permits firefighters to place their feet firmly in one spot and perform their tasks quickly and safely.

Some prior art such as U.S. Pat. No. 4,111,077 by Cummings et al. concern themselves to lowering costs and reducing weight. While desirable in some applications, a fire hydrant wrench must, first of all, be rugged, reliable, and above all, must be fool proof, quick acting and simple to operate under highly stressful conditions, severe weather conditions, and in the darkness of night.

Also, my invention has the highly desirable features of permitting size adjustments and ratchet reversing while wearing heavy wet gloves.

My invention facilitates placement of the wrench by using a socket that is open at both ends. This feature permits the firefighter to "sight down" as he of she places the wrench for adjusting the bolt to the nut. Also this permits the socket to clear lubrication fittings found on the top of some actuating nuts.

My invention offers an optional pawl actuating lever which permits rapid reversing of the pawl action with a minimum of hand pressure. This is particularly desirable today because of legal requirements that mandate the equal hiring consideration given to females and older applicants. Also, it may be noted that many volunteer fire departments have more older personnel than paid fire departments.

In addition, as an option, my invention provides a square hole, typically a ¾ inch square hole, suitable for socket drives for sockets used in the maintenance of vehicular and non-hydrant equipment.

Therefore, fire hydrant wrenches heretofore known have suffered from a number of disadvantages:

(A) Those wrenches mating with internal slots require slots that are free from dust, ice and corrosion—conditions not encountered in the real world.

(B) Non-adjustable wrenches require a multitude of sockets to fit the almost 100 sizes and shapes found on the fire hydrants in use today.

(C) Non-ratcheting types of wrenches require the fireman to move around the hydrants which is not always possible due to obstructions. Such wrenches greatly increase the time required to ready a hydrant for action because it is necessary to attach, turn a partial arc, remove and reattach the wrench on the caps for the hose connections as well as the top stem nut for opening and closing the water main.

(D) Even when hydrants have 360 degree accessibility, non-ratcheting wrenches require walking around the hydrant. This could lead to an accident due to poor footing conditions so often encountered at hydrants.

(E) Low cost wrenches such as those fabricated from stamped components often cannot endure the rugged environment of fire fighting situations. This includes the ability to withstand high torque, being run over by vehicles, and to function when exposed to dirt, water or ice.

(F) Wrenches requiring set screws, special handling, or special operating requirements do not meet the rugged, reliable, and quick action criteria a tool must meet for operation under the stressful conditions of fire fighting.

(G) Ratchet wrenches in the past were difficult or impossible to use when the fireman must wear heavy wet gloves.

(H) Wrenches with sockets closed at one end do not permit "sighting" the hydrant actuating nut.

(I) Wrenches with sockets closed at one end do not permit "sighting" of the lubrication fitting on some hydrant nuts and do not permit clearance for full and firm engagement of the socket when used on a nut with a lubrication fitting.

(J) Many wrenches in the past could not be disassembled for cleaning or replacement of worn or broken parts, (K) Some previous ratchet wrenches required a high digital pressure to reverse the pawl and were very awkward or impossible to reverse while wearing heavy gloves.

(L) Some prior wrenches damaged storage boxes and contents due to sharp edges.

(M) Many previous wrenches did not provide an optional square drive hole for attaching socket drives for the maintenance of vehicular or non-hydrant equipment.

(N) Some previous wrenches did not provide a simple to understand multiple configurated cavity that would engage hydrant nuts of various shapes and sizes by using an adjusting bolt for corresponding enclosure.

OBJECTS AND ADVANTAGES

Accordingly, besides the objects and advantages of the adjustable universal ratcheting fire hydrant wrench described in my above patent, several objects and advantages of the present invention are:

(A) To provide a wrench that fits virtually most or all shapes and sizes of hydrant nuts and caps in current use.

To provide a wrench that will open a fire hydrant that is partially obstructed.

(C) To provide a wrench that does not require walking around the hydrant.

(D) To provide a wrench that endures the rugged fire fighting environment.

(E) To provide a wrench that does not require special knowledge or training to use.

(F) To provide a wrench with a handle that may be operated when wearing heavy wet gloves.

(G) To provide a wrench to permit viewing through for quicker placement on the hydrant nut.

(H) To provide a wrench that fully clears hydrant nut lubrication fittings.

(I) To provide a wrench that may be disassembled for replacement of worn or broken parts.

(J) To provide a wrench with a ratcheting pawl that may be operated while wearing have wet gloves.

(K) To provide a wrench that will adjust to the nut or cap with an adjustment bolt that can be turned while wearing heavy wet gloves.

(L) To provide a wrench with rounded surfaces that will not damage storage compartments or other contents.

(M) To provide a wrench with a square hole for socket drives used for vehicular or non-hydrant maintenance purposes.

(N) To provide a wrench with a multiple configurated cavity that will engage hydrant nuts of various shapes and sizes.

BRIEF DESCRIPTIONS OF THE DRAWINGS

DESCRIPTION OF THE PREFERRED EMBODIMENT

Figure 1:
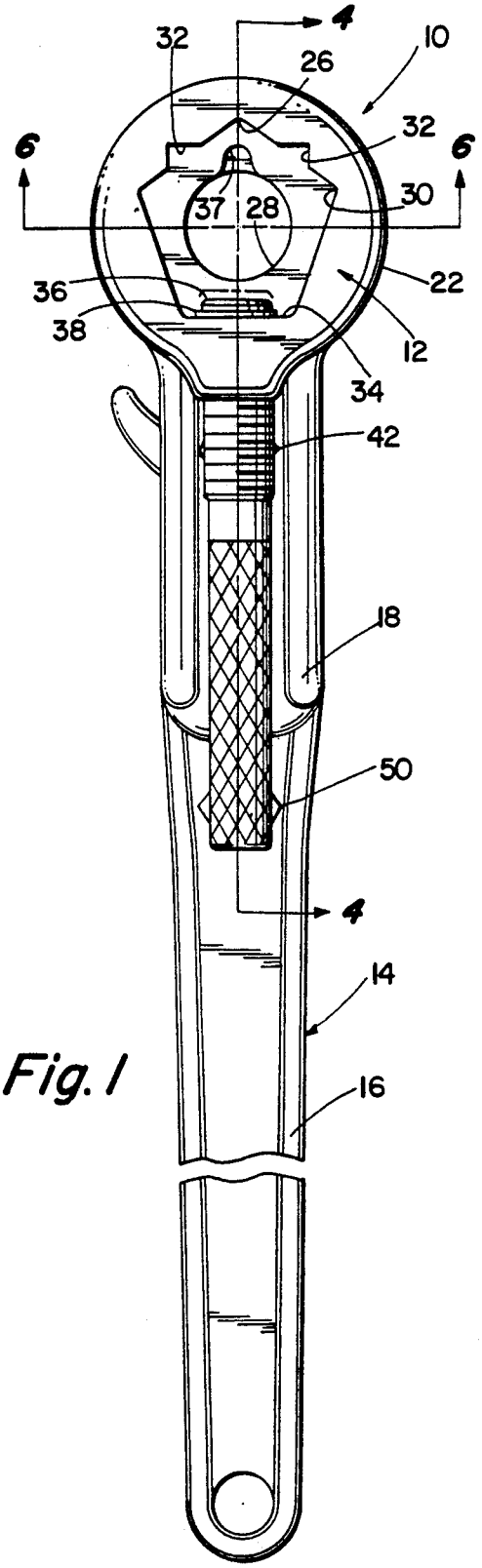
FIG. 1 is a front view.
Figure 2:
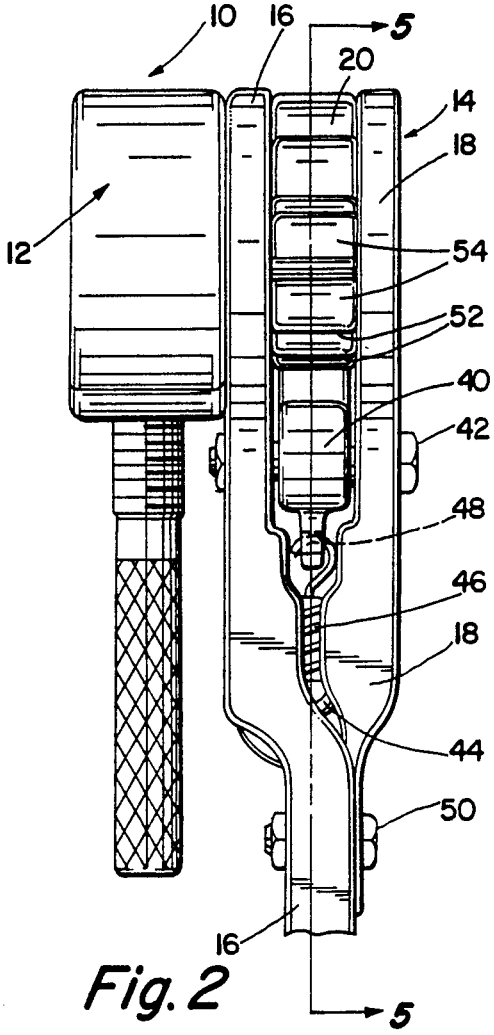
FIG. 2 is a partial side view.

A typical embodiment of the fire hydrant wrench of the present invention is illustrated in FIG. 1 (front view) and in FIG. 2 (partial side view). The wrench, indicated generally by reference numeral 10, is shown as having a wrenching arm 12 and ratcheting handle 14.

Figure 3:
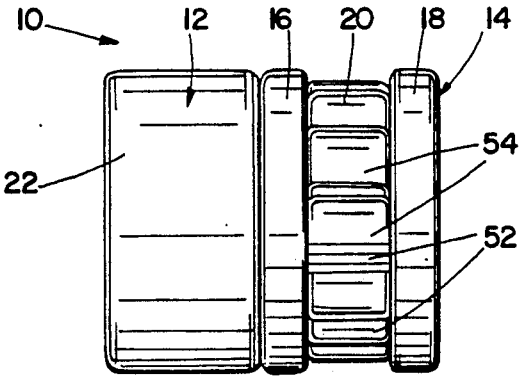
FIG. 3 is a top view.
Figure 4:
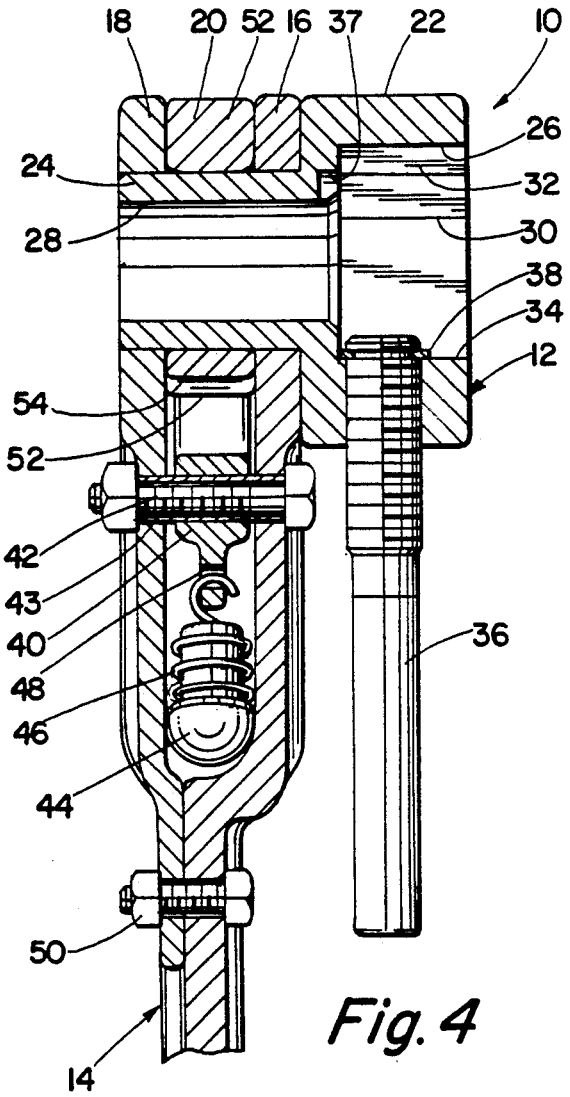
FIG. 4 is a vertical cross section view taken on line 4—4 of FIG. 1.
Figure 5:
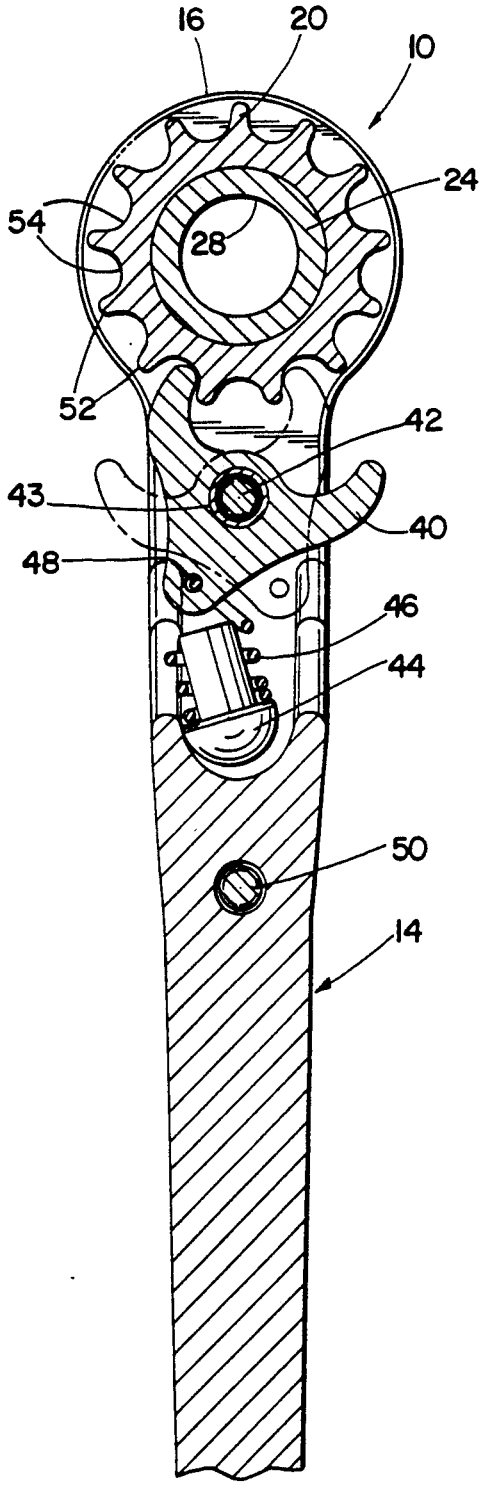
FIG. 5 is a vertical cross section view taken on line 5—5 of FIG. 2.
Figure 6:
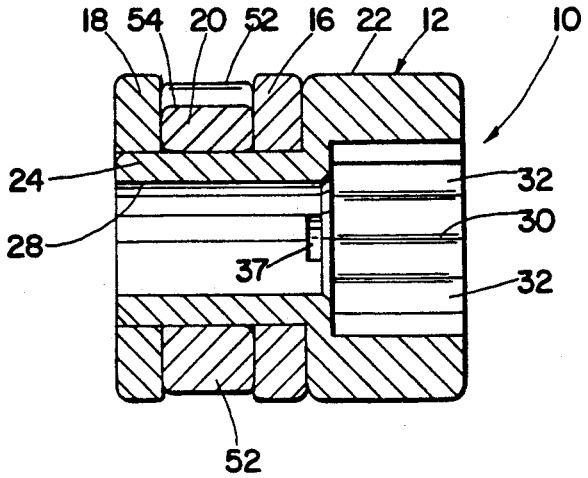
FIG. 6 is a horizontal cross section view taken on line 6—6 FIG. 1.

The wrenching arm 12, FIGS. 1, 2, 3 and in cross section views FIGS. 4, 5, 6 consists of a wrenching head portion 22, a shaft portion 24, a ratcheting gear 20 and an adjusting bolt 36. The wrenching head portion 22 having a hydrant nut engaging cavity 26. Said cavity consisting in combination of a pentagonal opening 30, square opening 32, sighting opening 28 and a notch 37 providing a clearance space for a hydrant nut lubrication fitting. A ratcheting gear 20 is rigidly attached to shaft 24 by suitable means (not shown) such as welding, pins, keyed or shrink fitting. Ratcheting gear 20 having gear teeth 52 and gear valleys 54. An adjusting bolt 36 protrudes through the wall of pentagonal opening 34 to force the hydrant nut into intimate contact with the pentagonal opening 30 or with square opening 32. An E-ring clamp 38 is provided to prevent loss of the adjusting bolt 36 due to accidental excessive manual retraction or vibration during movement of the firefighting vehicle.

Referring to FIG. 1 and FIG. 2, it can be seen wrench arm 12 is held in operating position and is actuated by ratcheting handle 14 which consists of a left side 16 and a right side 18 rigidly held together in parallel orientation by handle bolt assembly 50 and by pawl bolt assembly 42. Sleeve 43 insures that handles 16 and 18 cannot bind ratcheting gear 20 if pawl bolt assembly is overtightened and acts as the pivot or fulcrum of pawl 40.

Operation of pawl 40 may be understood by referring to cross section views FIGS. 4 and 5. Pawl 40 is held in a proper relationship to ratcheting gear 20 by sleeve 43 which in turn is secured between handle sides 16 and 18 by pawl bolt assembly 42 or optional bolt 62. Pawl 40 is free to rotate in an arc about sleeve 43, but is held in either extreme positions of the arc by spring 46 which in turn is held by spring guide 44 at one end and is attached at the other end to the pawl 40 by hooking through pawl spring hole 48. Digital pressure applied to the pawl 40 overcomes the force exerted by spring 46 and when pawl arc motion exceeds the center line of ratcheting handle 14 the spring 46 will then hold pawl 40 in the extreme arc position that is opposite to its initial position when the digital pressure was applied. This allows the pawl to engage gear valley 54 and rests between two gear teeth 52. Note that spring 46 operates in a compression mode despite the end configuration (hook) that is typically found in tension mode springs.

By exerting pressure or force on ratcheting handle 14 the transmittal of this force is applied to pawl 40 which exerts this pressure or force to the ratcheting gear 20 which is rigidly fixed to shaft 24 thereby causing rotation of this shaft resulting in rotation of the wrenching head 22 and 12. When the hydrant nut is captured in the cavity 26 and held in place by adjusting bolt 36 the rotation of the wrenching head 22 causes the hydrant nut to rotate in the preset direction of pawl 40. To reverse direction simply apply digital pressure on the opposite side of pawl 40 and apply the opposite manual force (push/pull) on handle 14. This permits the simple ratcheting action required.

Figure 7:
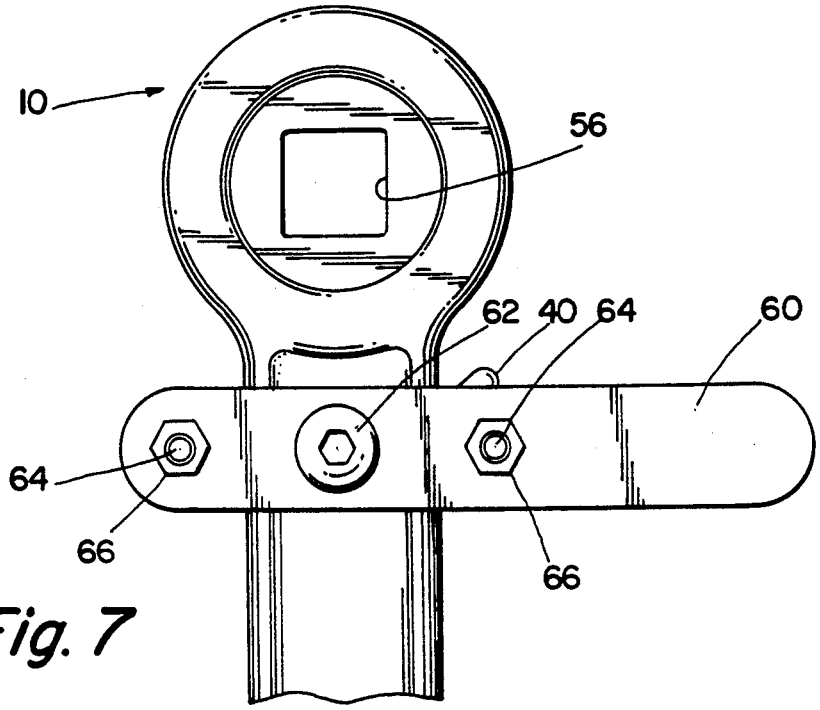
FIG. 7 is a partial rear view with optional pawl actuating lever assembly.
Figure 8:
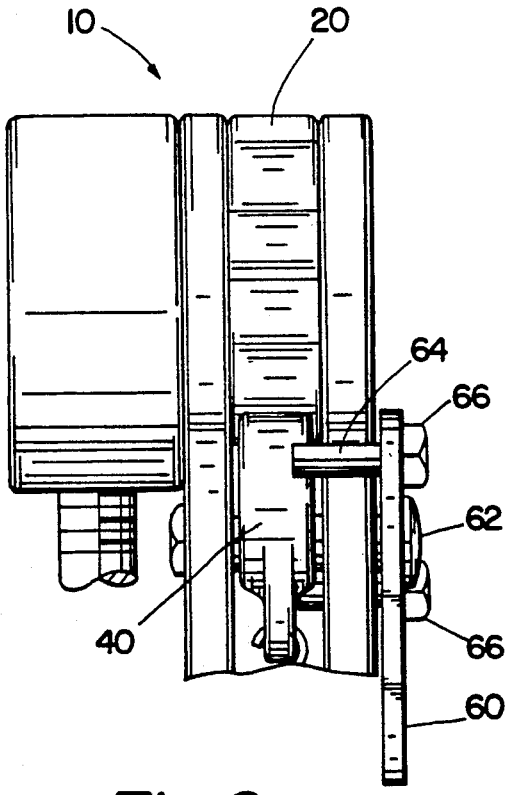
FIG. 8 is a partial side view with optional pawl actuating lever assembly.
Figure 9:
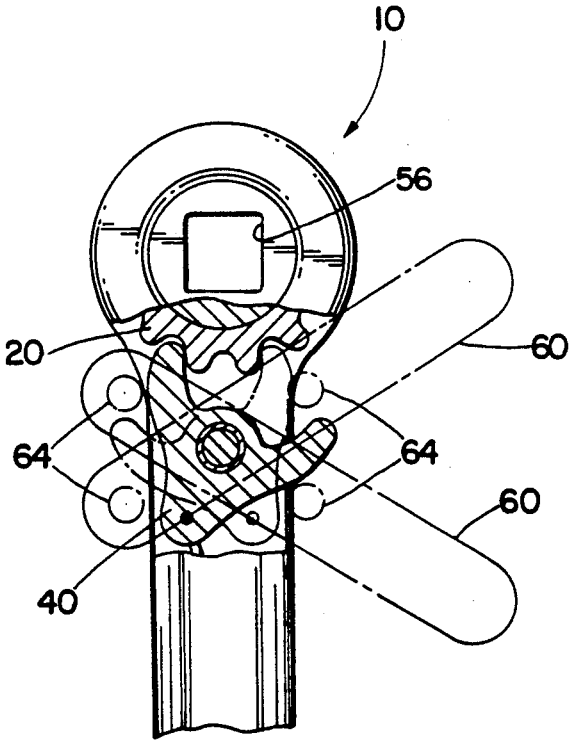
FIG. 9 is a partial rear view with optional pawl actuating lever motion indicated.

An optional pawl actuating lever 60 is shown in FIGS. 7, 8 and 9. The pawl actuating lever 60 is attached to the wrench by lever and pawl bolt assembly 62 which replaces bolt 42 and also functions as the pivot or fulcrum for the pawl actuating lever 60 and pawl 40. Pawl actuating pins 64 are attached to the pawl actuating lever 60 by pin nuts 66. The relatively large size of the pawl actuating lever 60 provides an easy to locate and operate pawl reversing means and the pawl actuating lever 60 may be operated while wearing bulky gloves. In addition the lever provides a mechanical advantage which reduces the force needed to reverse the pawl, an advantage necessary for some female and older firefighters.

The operation of the wrench can be understood by reference to FIGS. 1 and 2. The engaging cavity 26 of the wrenching arm 12 is placed on the fire hydrant nut or cap. Adjusting bolt 36 is then tightened against the fire hydrant nut or cap. While it may seem logical to simply observe which position the pawl is in to determine if it is in the tightening or loosening mode, most often ratchet wrench users give the wrench handle a push or pull for desired direction. If the desired rotation of the nut does not occur they simply reverse the ratcheting action by shifting pawl 40 to its alternate position.

An optional square hole 56 is shown is FIG. 7. Inserting a square socket drive provides a means for torquing sockets used in the maintenance of firefighting vehicles and equipment.

In a preferred embodiment, the ratchet wrench consists of a forged handle, a ratchet gear, an easy to operate pawl, a knurled adjustment bolt and an alloy metal multiple configurated socket which is open at both ends.

Although the invention is described with respect to a preferred embodiment, modifications thereto will be apparent to those skilled in the art.

I claim:

1. A ratcheting fire hydrant wrench comprising:

a. a handle having a head and a lever end;

b. a socket portion having a shank portion and an open end portion said open end portion defining a polygonal shape;

c. a ratchet gear secured to the shank portion of said socket and housed in the head of said handle;

d. a pawl means pivotally attached to said head in engagement with said ratchet gear and switchable between different positions;

e. a lever pivotally attached to said pawl means having a portion thereof extending laterally beyond the handle on both sides of the handle, wherein one laterally extending portion is longer than the other, said lever having means to engage said pawl means to cause said pawl means to pivot.

2. A ratcheting fire hydrant wrench of claim 1 further comprising a notch within said open end portion of said socket portion for engaging a lubrication fitting on said fire hydrant.

3. A ratcheting fire hydrant wrench of claim 1 further comprising an elongated adjustment bolt threadably secured to said socket portion such that the size of the open end portion is adjustable.

4. A ratcheting fire hydrant wrench of claim 3 further comprising a notch within said open end portion of said socket portion for engaging a lubrication fitting on said fire hydrant.

* * * * *